US005165244A

United States Patent [19]

Kleinberg et al.

[11] Patent Number: 5,165,244

[45] Date of Patent: Nov. 24, 1992

[54] PROCESS TO PRODUCE OXYGEN AND NITROGEN AT MEDIUM PRESSURE

[75] Inventors: William T. Kleinberg, Breinigsville; Leigh A. Stapf, Lansdale, both of Pa.

[73] Assignee: Air Products and Chemicals, Inc., Allentown, Pa.

[21] Appl. No.: 699,879

[22] Filed: May 14, 1991

[51] Int. Cl.[5] ..... F25J 3/02

[52] U.S. Cl. ..... 62/24; 62/39; 62/41

[58] Field of Search ..... 62/24, 39, 41

[56] References Cited

U.S. PATENT DOCUMENTS

| | | | |
|---|---|---|---|
| 2,918,802 | 12/1959 | Grunberg | 62/25 |
| 3,086,371 | 4/1963 | Schilling et al. | 62/13 |
| 4,372,764 | 2/1983 | Theobald | 62/41 |
| 4,617,036 | 10/1986 | Suchdeo et al. | 62/11 |
| 4,790,866 | 12/1988 | Rathbone | 62/24 |

*Primary Examiner*—Ronald C. Capossela
*Attorney, Agent, or Firm*—Willard Jones, II; William F. Marsh; James C. Simmons

[57] ABSTRACT

The present invention is an improvement to a process for the separation of air into its constituent components in a cryogenic distillation column system having a high pressure column and a low pressure column which are thermally integrated with each other. The improvement for producing both nitrogen and oxygen products at a medium pressure comprises the following steps: (a) operating the low pressure column at a pressure of between 10 to 75 psig and the high pressure column at a pressure which is about 60 to 160 psi higher than the low pressure column; (b) removing and subsequently warming at least a portion of the lower pressure nitrogen overhead from the top of the low pressure column and recovering the warmed, lower pressure nitrogen overhead portion as medium pressure gaseous nitrogen product; and (c) recovering medium pressure gaseous oxygen product from the low pressure column. There are two alternative ways to recover the medium pressure oxygen product of step (c). In the first, a portion of the liquid oxygen bottoms can be removed from the low pressure column and boosted in pressure, and then subsequently vaporized. This vaporized, boosted pressure, liquid oxygen is recovered as medium pressure gaseous oxygen product. In the second, a portion of the vaporized liquid oxygen bottoms is removed from the low pressure column and warmed. This warmed, vaporized liquid oxygen bottoms would be recovered as the medium pressure gaseous oxygen product.

3 Claims, 1 Drawing Sheet

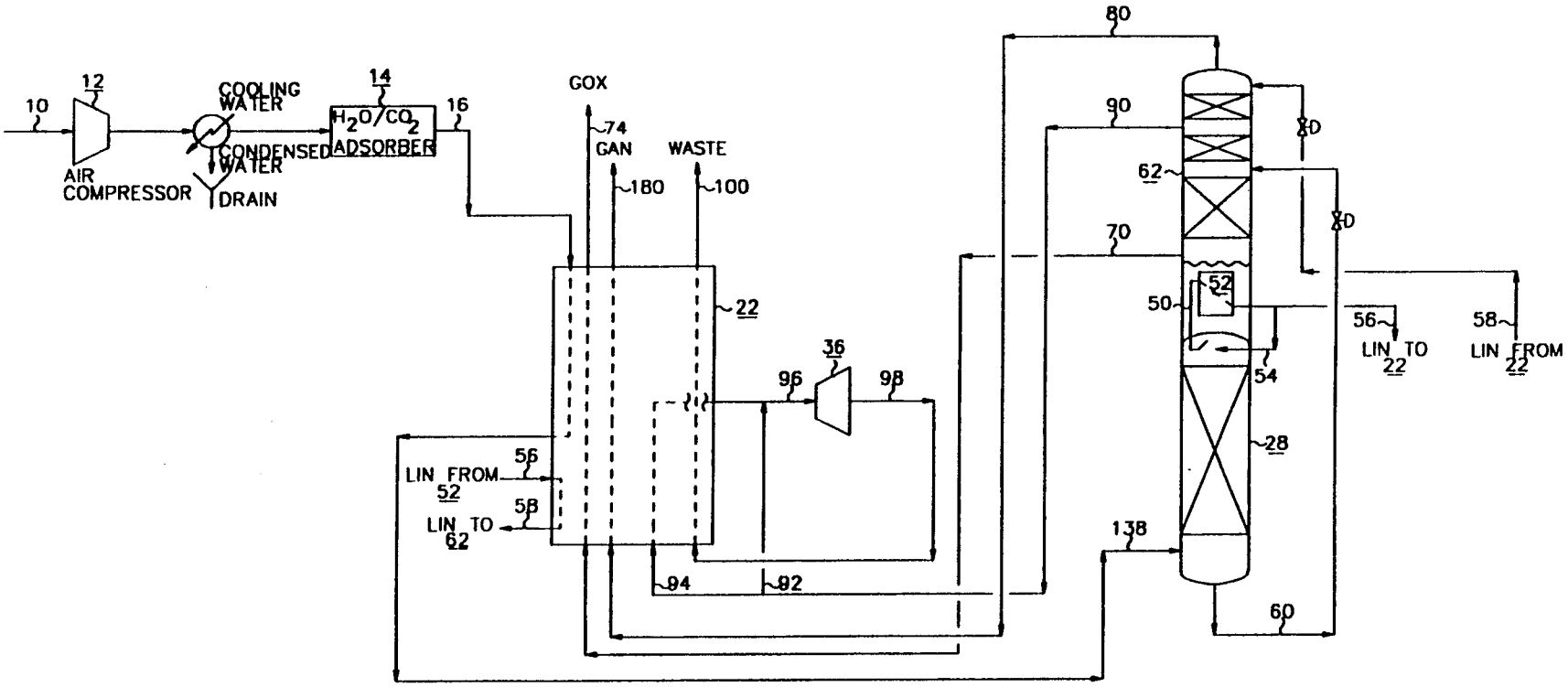
10
12
AIR COMPRESSOR
COOLING WATER
CONDENSED WATER
DRAIN
14
$H_2O/CO_2$ ADSORBER
16
GOX
74
GAN
180
WASTE
100
22
94
96
98
36
92
LIN FROM 52
56
LIN TO 62
58
LIN FROM 22
56
LIN TO 22
80
90
70
62
50
52
54
28
60
138

PROCESS TO PRODUCE OXYGEN AND NITROGEN AT MEDIUM PRESSURE

TECHNICAL FIELD

The present invention relates to a process for the cryogenic distillation of air into its constituent components. In particular, the present invention relates to a thermally-integrated, dual-column cryogenic air separation process which produces nitrogen and oxygen at medium pressure from the process.

BACKGROUND OF THE INVENTION

There is a growing need for air separation processes which produce nitrogen and oxygen at medium pressures, i.e. pressures between 10 and 75 psig. For example, the float glass industry presently requires the use of nitrogen in its furnace as an inerting atmosphere. This nitrogen typically must be supplied from the air separation unit at 25 psig. There is also an emerging use of oxygen in float gas facilities for enrichment of air to the burners or for oxy-fuel burners. This oxygen does not have to be high purity but is required at pressures of about 25 psig. A typical float glass plant will require about 150,000 SCFH of nitrogen and 50,000 SCFH of 95% oxygen. The aluminum manufacturing industry also has similar nitrogen requirements and the potential for the need of medium pressure oxygen in its burners. This requirement of providing both nitrogen and oxygen at medium pressure raises a problem for the industrial gas industry. That problem being what is the most economical method of supplying these oxygen/nitrogen requirements.

The conventional method of supplying oxygen and nitrogen at these medium pressures has been to use a low pressure air separation unit in which the low pressure column works at 2–9 psig. The oxygen and nitrogen products are then compressed to required pressure.

U.S. Pat. Nos. 2,918,802 and 3,086,371 disclose pumped liquid oxygen processes in which liquid oxygen is vaporized and warmed against a part of the air feed. This eliminates the requirement for an oxygen compressor but adds a LOX pump to the process and complicates the air compression by requiring two air compressors.

Patent application U.S. Ser. No. 07/564,803 discloses another pumped liquid oxygen process.

U.S. Pat. No. 4,617,036 discloses a process in which the low pressure column is operated at about 45 to 70 psia. The nitrogen product from the column is warmed against the air. This process produces the nitrogen product at the desired pressure without a need for additional pressure, but, unfortunately, medium pressure oxygen is not produced.

SUMMARY OF THE INVENTION

The present invention is an improvement to a process for the separation of air into its constituent components in a cryogenic distillation column system having a high pressure column and a low pressure column which are thermally integrated with each other. In the process, feed air is compressed and cooled to near its dew point and fed to the high pressure column for rectification into a higher pressure nitrogen overhead and a crude liquid oxygen bottoms. The crude liquid oxygen bottoms liquid is reduced in pressure and fed to the low pressure column for distillation into a lower pressure nitrogen overhead and a liquid oxygen bottoms. Also, at least a portion of the liquid oxygen bottoms is vaporized in heat exchange against the higher pressure nitrogen overhead. Finally, at least a portion of the high pressure nitrogen overhead is condensed by heat exchange against the liquid oxygen bottoms, and a portion of the condensed high pressure nitrogen overhead is used to provide liquid reflux to the low pressure column.

The improvement for producing both nitrogen and oxygen products at a medium pressure comprises the following steps: (a) operating the low pressure column at a pressure of between 10 to 75 psig and the high pressure column at a pressure which is about 60 to 160 psi higher than the low pressure column; (b) removing and subsequently warming at least a portion of the lower pressure nitrogen overhead from the top of the low pressure column and recovering the warmed, lower pressure nitrogen overhead portion as medium pressure gaseous nitrogen product; and (c) recovering medium pressure gaseous oxygen product from the low pressure column. There are two alternative ways to recover the medium pressure oxygen product of step (c). In the first, a portion of the liquid oxygen bottoms can be removed from the low pressure column and then vaporized. This vaporized, liquid oxygen, which is recovered as medium pressure gaseous oxygen product, will be at a higher pressure than the low pressure column due to static head. In the second, a portion of the vaporized liquid oxygen bottoms is removed from the low pressure column and warmed. This warmed, vaporized liquid oxygen bottoms would be recovered as the medium pressure gaseous oxygen product.

Refrigeration can be provided to the process by removing a nitrogen-rich stream from the low pressure column, expanding the removed, nitrogen-rich stream, and warming the expanded, removed, nitrogen-rich stream to recover the produced refrigeration, by heat exchange with other process streams.

BRIEF DESCRIPTION OF THE DRAWING

The single figure of the drawing is a schematic diagram of the process of the present invention.

DETAILED DESCRIPTION OF THE INVENTION

In the process of the present invention, the pressure of the low pressure column is increased from the conventional 2–9 psig to an elevated pressure of 10 to 75 psig. The nitrogen product taken from the process is produced at the pressure of the low pressure column. For processes which use the nitrogen at 10 to 75 psig, the nitrogen can be used without further compression. The oxygen product is also produced at low pressure column pressure, or if desired the oxygen pressure can be increased by about 10–15 psig by taking the oxygen from the column as a liquid and boosting its pressure using static head prior to vaporizing.

The process of the present invention is illustrated in the single figure of the drawing. Feed air, in line 10, is compressed in air compressor 12. With the low pressure column operating at 42 psia in order to produce 25 psig nitrogen pressure, the air compressor discharge pressure is 155 psia. The compressed feed air is then cooled to condense water vapor. The air from the cooler is then directed to a set of switching mole sieve adsorbers 14 to remove water, carbon dioxide, and heavy hydrocarbons which may be contained in the feed air and which will freeze out in the process at cryogenic temperatures. The dry, carbon dioxide-free, compressed feed air is removed from adsorber 14, via line 16, and then directed to heat exchanger 22.

Air, from line 16, is cooled in heat exchanger 22 to a temperature slightly above its dew point. This air is then fed to the high pressure distillation column 28 via line 138.

In high pressure column 28, the air is separated into a high pressure nitrogen overhead and a crude oxygen bottoms liquid. The high pressure nitrogen overhead is removed from high pressure column 28, via line 50, and fed to reboiler-condenser 52 located in the bottom of low pressure column 62, wherein it is condensed and subsequently divided into two substreams. The first column substream in line 54, is fed to the top of high pressure column 28 as pure liquid nitrogen reflux. The second substream, in line 56, is subcooled in heat exchanger 22, reduced in pressure, and fed to the top of low pressure column 62 as pure liquid nitrogen reflux. The crude oxygen bottoms liquid is removed, via line 60, from high pressure column 28, reduced in pressure, and fed to an intermediate location of low pressure column 62 for distillation. In low pressure column 62, this crude oxygen is distilled into a medium pressure nitrogen overhead and a liquid oxygen bottoms.

The liquid oxygen bottoms is boiled against the condensing nitrogen in reboiler-condenser 52, thereby producing boil-up for low pressure column 62 as well as producing a vapor product stream. The gaseous oxygen product is removed, via line 70, from the bottom of low pressure column 62, warmed in heat exchanger 22, and recovered as medium pressure oxygen product, in line 74. Alternately, product oxygen can be removed as a liquid from low pressure column 62, have its pressure increased by static head and then vaporized in heat exchanger 22 for cases where higher oxygen pressures are required.

The medium pressure nitrogen overhead is removed via line 80, from low pressure column 62, and subsequently warmed in heat exchanger 22 to recover refrigeration.

In addition, a waste stream is removed, via line 90, from an upper intermediate location of low pressure column 62 and can then be split into two portions. The first portion, in line 94, is warmed to about −100° F. to −150° F. in heat exchanger 22 and recombined with the second portion, in line 92. The combined stream, in line 96, is expanded in expansion turbine 36 to produce plant refrigeration. The turbine exhaust, in line 98, is subsequently warmed in heat exchanger 22 to recover refrigeration. A portion of the waste, in line 100, from heat exchanger 22 is used to reactivate the off-stream mole sieve adsorber 14.

This cycle is useful for co-production of oxygen (95 to 99.8 mol % $O_2$) and high purity gaseous nitrogen (5 vppm $O_2$) at pressures ranging from 10 to 75 psig and most beneficial at pressures of 20 to 35 psig and nitrogen to oxygen flow ratio requirement at about three. Although not described herein, an argon column can be added to the process to recover an argon product.

Producing the nitrogen and oxygen products from an elevated pressure cycle allows for economic supply of oxygen/nitrogen products at about 25 psig. This invention allows elimination of product compressors that have been traditionally required for low pressure cycle and, for a product split of 150,000 SCFH $N_2$/50,000 SCFH $O_2$, gives a power savings of about 3% when compared to the LP cycle.

Increasing the pressure of the process allows all equipment to be downsized and therefore less costly. In addition, by having all compression in one machine (the air compressor), rather than three machines (air, oxygen, and nitrogen compressors); the cost of the compression equipment is reduced significantly. Use of the invention to supply float glass and aluminum mill typical requirements of 150,000 SCFH $N_2$/50,000 SCFH $O_2$, both at 25 psig, yield a power savings of 3% when compared to the traditional low pressure cycle.

We claim:

1. In a process for the separation of air into its constituent components in a cryogenic distillation column system having a high pressure column and a low pressure column which are thermally integrated with each other, wherein feed air is compressed and cooled to near its dew point and fed to the high pressure column for rectification into a higher pressure nitrogen overhead and a crude liquid oxygen bottoms; the crude liquid oxygen bottoms liquid is reduced in pressure and fed to the low pressure column for distillation into a lower pressure nitrogen overhead and a liquid oxygen bottoms; at least a portion of the liquid oxygen bottoms is vaporized in heat exchange against the higher pressure nitrogen overhead; at least a portion of the high pressure nitrogen overhead is condensed by heat exchange against the liquid oxygen bottoms and a portion of the condensed high pressure nitrogen overhead is used to provide liquid reflux to the low pressure column, the improvement for producing both nitrogen and oxygen gaseous products at a medium pressure and at a flow ratio of nitrogen to oxygen of about three to one (3:1) comprises the following steps:

(a) operating the low pressure column at a pressure of between 10 to 75 psig and the high pressure column at a pressure which is about 60 to 160 psi higher than the low pressure column;

(b) removing a nitrogen-rich stream from the low pressure column and expanding the removed, nitrogen-rich stream to provide refrigeration;

(c) removing and subsequently warming at least a portion of the lower pressure nitrogen overhead from the top of the low pressure column and recovering the warmed, lower pressure nitrogen overhead portion as medium pressure gaseous nitrogen product; and (d) recovering medium pressure gaseous oxygen product from the low pressure column.

2. The process of claim 1 wherein step (d) comprises removing and subsequently warming a portion of the vaporized liquid oxygen bottoms from the low pressure column and recovering the warmed, vaporized liquid oxygen as medium pressure gaseous oxygen product.

3. The process of claim 1 wherein step (d) comprises removing a portion of the liquid oxygen bottoms from the low pressure column, boosting the pressure of the removed, liquid oxygen by means of static head and then subsequently vaporizing the boosted pressure, liquid oxygen and recovering this vaporized boosted pressure, liquid oxygen as medium pressure gaseous oxygen product.

* * * * *